US005979117A

United States Patent [19]

Fuller

[11] Patent Number: 5,979,117

[45] Date of Patent: Nov. 9, 1999

[54] HOLE LOCKING DEVICE

[76] Inventor: Frank Fuller, 16224 N. 21st St., Phoenix, Ariz. 85022

[21] Appl. No.: 09/095,514

[22] Filed: Jun. 10, 1998

[51] Int. Cl.[6] ..... E02D 29/14

[52] U.S. Cl. ..... 52/19; 404/25

[58] Field of Search ..... 52/19–21; 404/2, 404/4, 24–26

[56] References Cited

U.S. PATENT DOCUMENTS

| | | |
|---|---|---|
| 3,426,659 | 2/1969 | Clarke . |
| 4,101,154 | 7/1978 | Kagstrom . |
| 4,974,992 | 12/1990 | Harter . |
| 5,052,851 | 10/1991 | Frishauf . |
| 5,328,291 | 7/1994 | Wisniewski . |
| 5,403,116 | 4/1995 | Brewer . |

*Primary Examiner*—Beth Aubrey

*Attorney, Agent, or Firm*—LaValle D. Ptak

[57] ABSTRACT

A safety hole cover particularly useful in providing temporary protection for drilled and augured holes has a flange portion which is placed on the ground surrounding the hole. This flange portion has a circular opening through it; and the diameter of this opening is at least as great as the diameter of the largest hole to be covered by the hole cover. A domed housing fits over the opening in the flange, and telescoping cylindrical sections are located within the housing. The external diameters of the telescoping cylindrical sections are selected to correspond to the internal diameters of different holes with which the device is to be used. The lowermost (and smallest) cylindrical section has retractable fingers or spikes in it for extension outwardly from the side of the section to engage the side walls of a hole when the device is in place over the hole. The housing provides a visible indication of the presence of the device; and by locking the device in place, removal by vandals is inhibited. The cylindrical sections also protect the integrity of the hole by reducing the potential for collapse of the hole.

16 Claims, 3 Drawing Sheets

FIG. 1
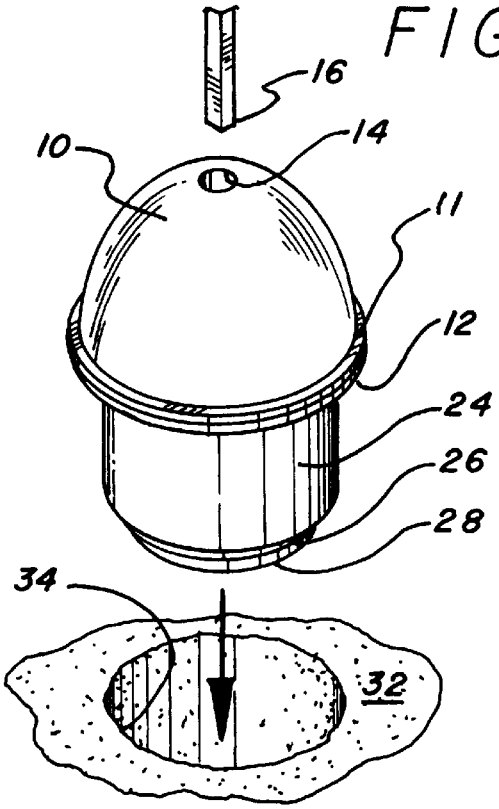
FIG. 2
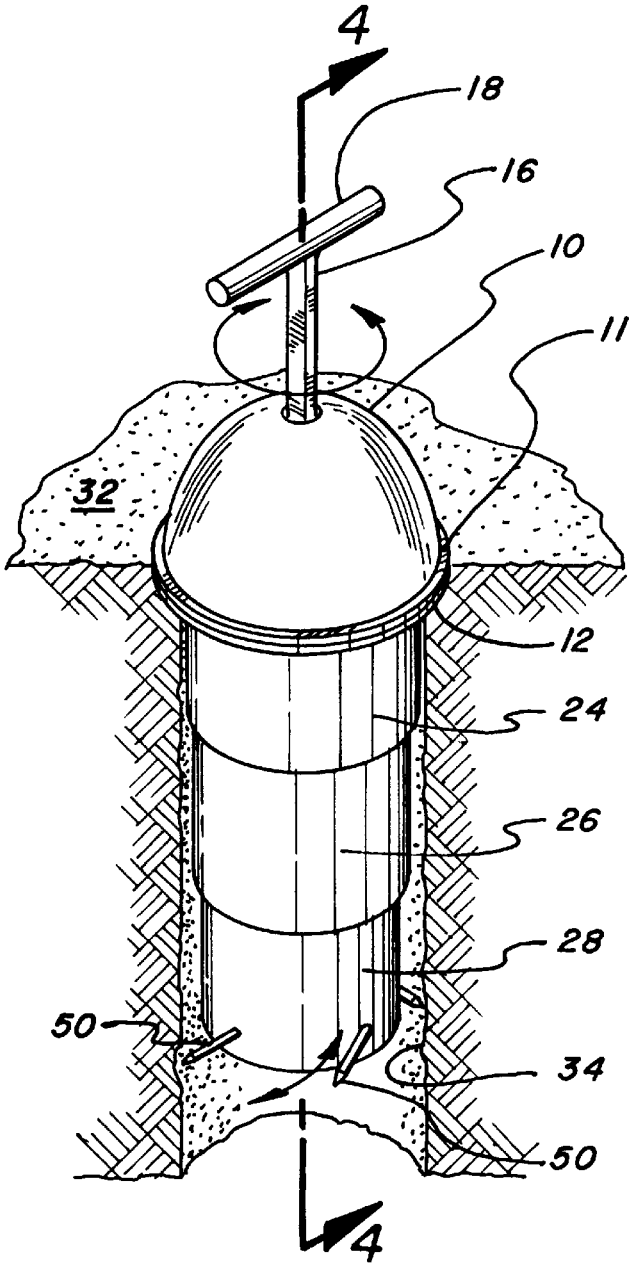
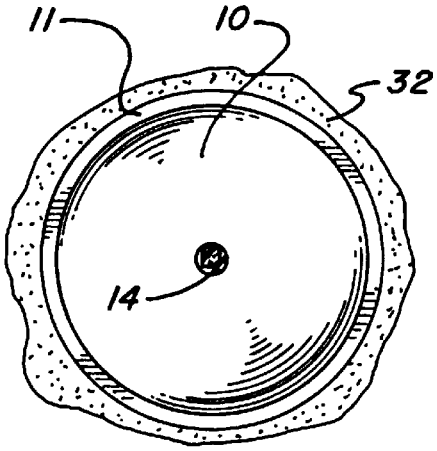
FIG. 3

FIG. 5
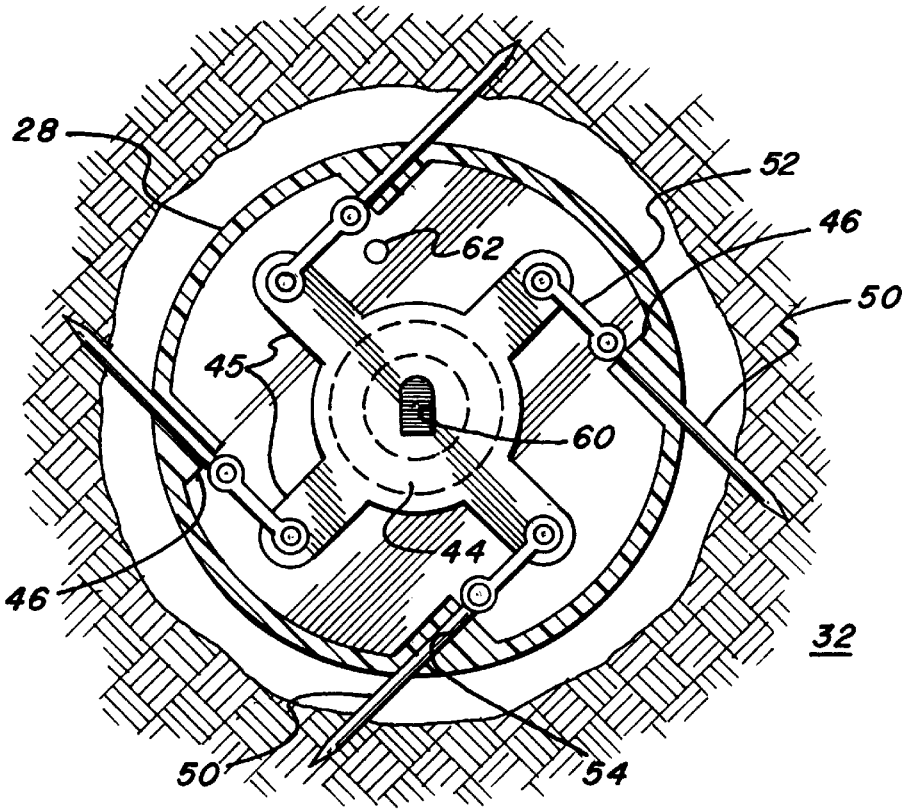
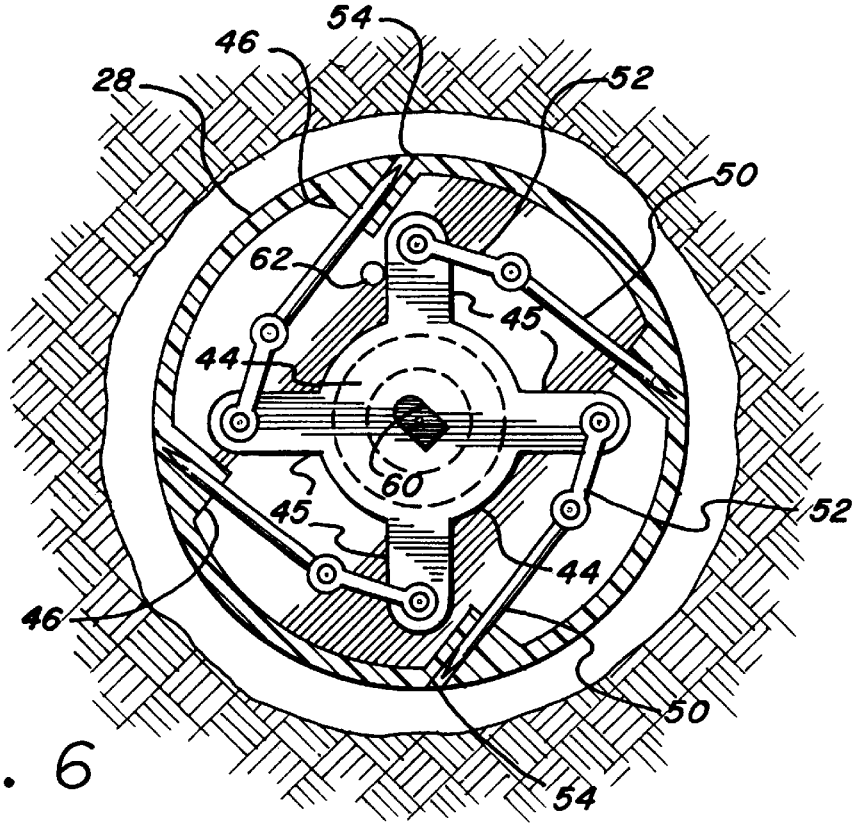
FIG. 6

HOLE LOCKING DEVICE

BACKGROUND

Construction sites frequently include excavations in the form of ditches and holes to be used in the construction process. Such ditches and holes present a safety hazard whenever they must be left open, particularly at a time when construction crews are not present. Safety regulations currently in place in most locations in the United States require some type of warning or cover to be placed on such ditches or holes to prevent potential injury. In addition, covers are used to prevent vandalism or accidental damage to the ditch or hole.

Current methods which are used to provide safety or warning of the presence of a hole range from a taping off or fencing off of the region in which the hole is located, or covering the hole with plywood, pallets or the like. If warning tapes or plywood sheets are used, dangers still exist if children or vandals uncover the hole, creating the potential for injuries and consequent liabilities.

Manhole covers for permanent manhole installations exist. Typically, manhole covers are made in the form of a very heavy, circular plate, which closely fits into a recess around the lip of the manhole. Such plates require special tools or relatively heavy machinery in order to remove them. A locking manhole insert or a locking manhole cover for suspending equipment beneath a cover is disclosed in the Wisniewski U.S. Pat. No. 5,328,291. This patent discloses a safety cover for manholes which is to be placed beneath a conventional manhole cover. The safety cover disclosed in the Wisniewski patent includes a plurality of arms which may be extended outwardly by rotating a central cam. A provision then is made in this patent for locking the arms in place with a padlock; so that the cover cannot be removed, since the arms extend under the lip of the manhole opening. The cover has chains attached to its underside for holding a container of equipment in suspension beneath the cover.

The Kagstrom U.S. Pat. No. 4,101,154 discloses a hole cover for well holes or the like. The hole cover is equipped with a self-locking mechanism in it. The locking mechanism comprises at least a pair of diametrically opposed arms, which are pivotally attached to a central shaft extending downwardly from the center of the well cover. These arms have a length chosen to cause them to slidably engage the wall of the hole when the cover is placed over the hole. The arms are not driven into the side walls of the hole; but if an attempt is made to remove the cover, the arms tend to pivot more tightly to engage the sides of the hole, preventing removal of the cover. When removal is desired, a rod or key is inserted through an aperture in a central tube attached to the cover to engage the lower ends of the pivoting arms to readily move them out of engagement with the hole. When the rod is in place, the cover then readily can be removed. The arms do not extend into the sides of the hole or well, but act as a wedge if an attempt is made to lift the cover from the well opening.

Other patents which disclose specific devices for locking a cover in place over a hole exist. The Brewer U.S. Pat. No. 4,053,116 is directed to a cover which can be placed over an exposed tubular pipe in a road. A relatively large plate covers the excavation; and the cover includes a portion which extends downwardly into the exposed pipe to hold it in place. The plate, which is the primary cover over the opening, is very heavy, requiring construction equipment to lift it into place and to remove it when it no longer is needed.

The Clarke U.S. Pat. No. 3,426,659 is directed to a road excavation cover which is anchored in place by means of a horizontally arranged jack attached to the underside of the cover. The jack is operated to wedge the ends of the jack into engagement with the sides of the excavation to hold the cover in place; so that it cannot readily be moved or dislodged. This is not a hole cover for circular vertical holes.

It is desirable to provide a safety hole cover for holes which are drilled vertically into the ground for protecting the holes themselves from collapse, and further for preventing injuries to persons who otherwise might accidentally step into such a hole. It further is desirable to provide a such a hole cover which is portable, easy to install, relatively inexpensive, and which protects against unauthorized removal.

SUMMARY OF THE INVENTION

It is an object of this invention to provide an improved emergency cover for holes.

It is another object of this invention to provide a locking hole cover for construction holes.

It is an additional object of this invention to provide a locking hole cover for holes on a construction site which further protects the upper portion of the hole from collapsing.

It is a further object of this invention to provide a telescoping hole cover for use on a construction site, which automatically adjusts to the internal diameter of the hole to prevent the upper portion of the hole from collapsing, and which is locked into place to prevent unauthorized removal.

In accordance with a preferred embodiment of the invention, a safety hole cover includes a flange which has upper and lower sides for placement over a hole. The flange has an opening through it, with dimensions which are at least as great as the dimensions of the largest hole to be covered by the hole cover. A housing is secured to the upper side of the flange and extends over and covers the opening. A first sleeve, with upper and lower ends, is slidably retained in the opening for movement from a storage position in the housing to a use position extending downwardly below the lower side of the flange, through the opening in the flange, into a hole to be covered. Movable engagement fingers adjacent the lower end of the sleeve move from a retracted position within the sleeve to an extended position to engage the side walls of the hole when the safety hole cover is in place over the hole.

BRIEF DESCRIPTION OF THE DRAWINGS

FIG. 1 is a top perspective view of a preferred embodiment of the invention illustrating the manner of its use;

FIG. 2 is a top perspective view of a preferred embodiment of the invention illustrating it in a position of use;

FIG. 3 is a top view of the embodiment shown in FIGS. 1 and 2;

FIG. 5 is a cross-sectional view taken along the line 5—5 of FIG. 4; and FIG. 6 is the same view as in FIG. 5 showing a different operating orientation of the various parts shown in FIG. 5.

DETAILED DESCRIPTION

Figure 4:
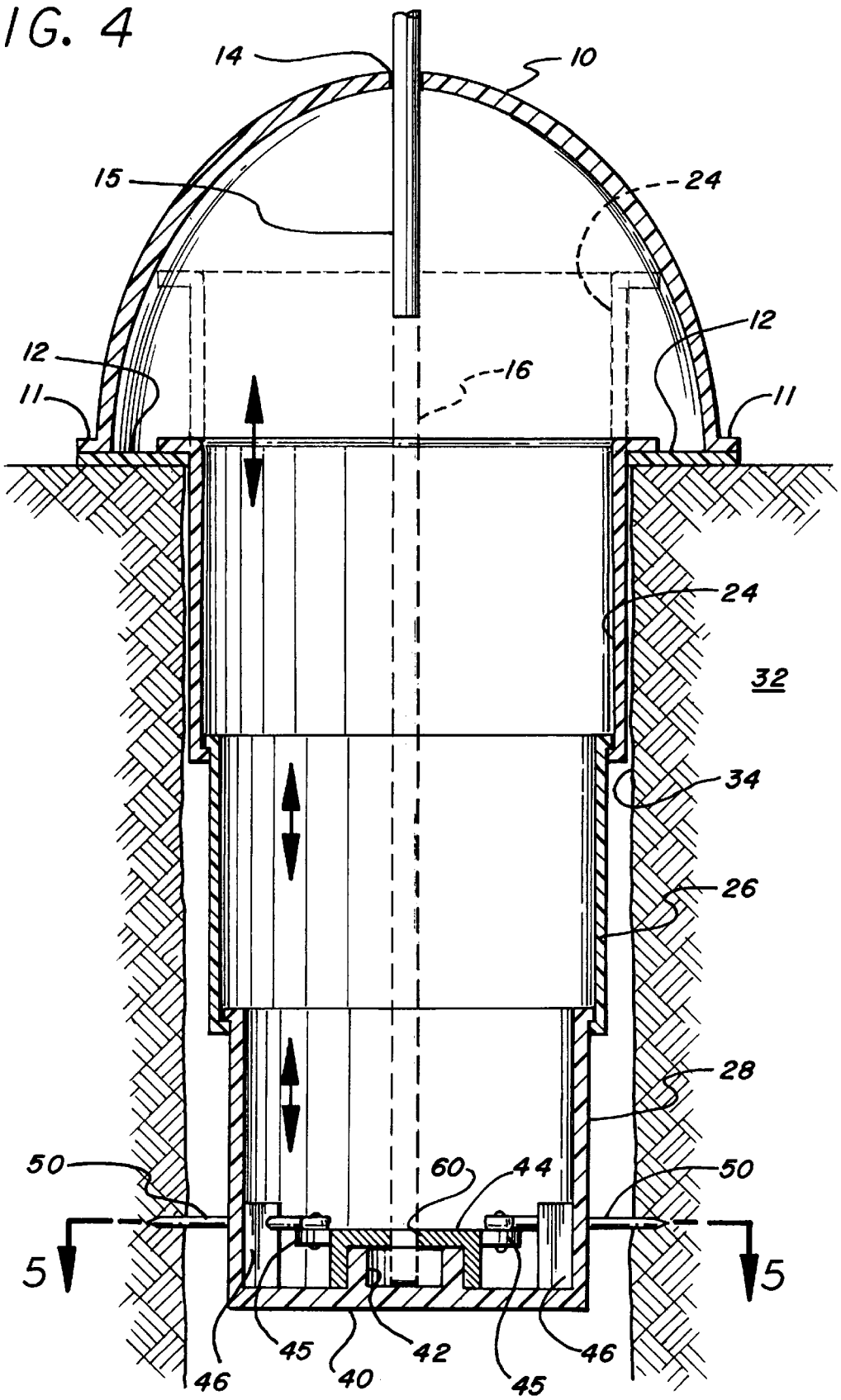
FIG. 4 is a cross-sectional view taken along the line 4—4 of FIG. 2.

Reference now should be made to the drawings, in which the same reference numbers are used throughout the different figures to designate the same components. A telescoping safety hole cover for use primarily with augured holes at a construction site is illustrated in FIG. 1. The hole cover itself includes a circular flange 12 (FIG. 4), which has a housing 10 extending above a circular hole in the flange 12. The housing 10 is attached to the flange 12 by an overlapping flange 11 (FIG. 4) and completely covers the hole through the center of the flange 12. As illustrated, the housing 10 may be a hemispherical shape; but it also could be in the form of a cylindrical section with a flat top, if desired.

As may be most apparent from an examination of FIG. 4, the safety hole lock of the invention includes a set of telescoping cylindrical sections 24, 26 and 28 of increasingly reduced diameters (as illustrated in FIGS. 2 and 4), which extend. downwardly into the hole 34 which is to be covered. The outside diameters of the cylinders 24, 26 and 28 are selected to be standard diameters of different sized holes typically encountered in a construction site. Of course, if a hole cover of the type shown in FIGS. 1 and 2 is to be employed with only holes of one size and this universal telescoping arrangement as illustrated in FIGS. 2 and 4 is not desired, only one section, such as the section 24, then would be necessary. The device which is illustrated, however, includes telescoping sections which have inwardly turned lips on the lower end and outwardly turned lips on the upper end of the upper and intermediate sections 24 and 26; so that all of the sections can collapse into one another and into the housing 10 when the device is in its stored or non-use position. This causes the entire structure to be compact when it is moved from job site to job site or stored. This is the transport position with all sections 24 to 26 located inside the housing 10.

When the device is lowered into a hole 34 in the ground 32, as illustrated in FIG. 1, the lowermost section 28 first drops into place. If the hole has an internal diameter which corresponds to the external diameter of the section 28, the section 28 is the only section which would drop into the hole, with the other sections remaining collapsed or telescoped into the interior of the housing 10 (as shown in dotted lines in FIG. 4). The lower lip of the section 26 then would rest on top of the ground inside the housing 10 and adjacent the inner edge of the circular flange 12. This is most readily apparent from an examination of FIG. 4. If on the other hand the hole 34 has an internal diameter which corresponds to the external diameter of the section 26, both the sections 28 and 26 drop into the hole; and the lower edge or lip of the section 24 rests on the top of the ground, with the section 24 then being collapsed or telescoped into the housing 10. Finally, if the hole is of the greatest diameter corresponding to the external diameter of the section 24, all three sections drop into place, as illustrated in FIGS. 2 and 4, with the outwardly turned flange on the upper edge of the section 24 engaging the flange 12, which rests on the ground beneath the flange 11 used to secure the domed housing 10 in place onto the doughnut-shaped circular flange 12.

Once the device is in place in a hole as shown in FIGS. 2 and 4, an operating rod or key 16, which has a non-circular configuration at least at its lower end, is inserted downwardly through an aperture 14 in the top of the housing 10 and through a guide pipe 15, which extends part way into the interior of the housing 10, but which does not extend below the plane of the flange 12. This rod then engages a corresponding shaped opening in a rotatable plate 44, which is carried on an upwardly projecting ring 42 in the closed bottom end 40 of the lowermost section 28 of the device. The plate 44 is freely rotatable about the ring 42 and carries four outwardly extending arms 45, as illustrated most clearly in FIGS. 4, 5 and 6. The arms 45 in turn are pivotally connected through a double pivot arrangement to corresponding locking fingers or spikes 50, which are illustrated as having pointed ends. These spikes 50 are arranged to reciprocally pass through openings 54 located adjacent the lower end of the cylindrical section 28 in four corresponding support blocks 46 (again, shown most clearly in FIGS. 4, 5 and 6).

When the apparatus is first placed over a hole and the telescoping sections 24, 26 and 28 are permitted to drop into place (depending upon the internal diameter of the hole, as described above), the spikes 50 initially are located in the position shown in FIG. 6. This is a storage position of this portion of the device. Consequently, the device readily drops into the hole without any interference from the ends of the projection spikes 50, as is readily apparent from an examination of FIG. 6.

Once the device is in place, as illustrated in FIGS. 2 and 4, however, the operating rod or key 16 is rotated by the handle 18 in a clockwise direction, as viewed from the top. This rotates the circular plate 44, by means of the non-circular keyway 60, from the position shown in FIG. 6 to the position shown in FIG. 5. As illustrated in FIG. 5 and also in FIGS. 2 and 4, the rods or spikes 50 extend outwardly through the openings 54 to engage the side walls of the hole 34 in the ground 32. This prevents vandals from lifting the device out of the hole and firmly holds the entire assembly in place in the hole. When removal of the device is desired, the rod 16 once again is inserted through the guide pipe 15 to engage the keyway 60 in the plate 44. Then, the handle 18 is rotated counterclockwise, as viewed in FIG. 2, to rotate the plate 44 from the position shown in FIG. 5 to the storage or non-engaged position shown in FIG. 6. With the device in this configuration, the entire assembly easily can be lifted out of the hole to permit desired construction with respect to the hole to take place.

The mushroom-shaped or domed top which is employed on the hole cover illustrated in the drawings is considered desirable, since it can be painted with a reflective paint to make it visible to persons in the vicinity of the hole. By shaping it in the manner shown, it is less likely to be tripped over; and by causing it to extend 12" to 16" above the hole, it also provides a suitable warning to persons operating construction equipment nearby to avoid this area. In addition to the safety feature which is readily apparent through the covering of the open hole, the cylinders 24, 26 or 28, which engage the upper edge of the hole, help to preserve the integrity of the hole itself until the next step in construction utilizing the hole takes place. Thus, accidental collapse of the upper portion of the hole, thereby filling the lower portion with debris, is significantly reduced. Thus, even if a truck should crush part or all of the housing 10 accidentally, the flange 12 and sections 24 to 28 prevent collapse of the upper part of the hole 34.

When the rod or key 16 is removed from the device, the locking spikes 50 remain in place and cannot be dislodged from above the ground. It is necessary to have the elongated rod or key 16 in order to operate the rotating plate 44 to disengage the spikes 50 to remove the hole cover.

The dimensions of the hole cover are selected to typically cover a range of holes of standard diameters and of diameters which do not vary a great deal from one another. For example, the lowermost section 28 may be selected to have a 10" external diameter, with the next section 26 having a 12" diameter; and the uppermost section 24 having a 14" external diameter. These are standard diameter sizes which are extensively used in construction; so that a single hole cover constructed in accordance with the techniques illustrated in FIGS. 1 through 6 may be used in any of these holes. Since the cover is somewhat universal, it then is not necessary to maintain an inventory of different sized covers for each different sized hole which is likely to be encountered by a contractor.

The foregoing description of the preferred embodiment of the invention is to be considered as illustrative and not as limiting. Various changes and modifications will occur to those skilled in the art for performing substantially the same function, in substantially the same way, to achieve substantially the same result, without departing from the true scope of the invention as defined in the appended claims.

What is claimed is:

1. A safety hole cover including in combination:

a flange member having upper and lower sides for placement over a hole, said flange member having an opening therethrough;

a housing secured to said flange member and extending over and covering the opening in said flange member;

a first sleeve with upper and lower ends slidably retained in the opening in said flange member for movement from a storage position in said housing to a use position extending downwardly below the lower side of said flange member through the opening in said flange member into the hole to be covered; and movable engagement fingers adjacent the lower end of said sleeve for movement from a retracted position within said sleeve to an extended position to engage side walls of the hole when said safety hole cover is in place over the hole.

2. The combination according to claim 1 wherein the opening in said flange member is a circular opening and said safety hole cover is designed to cover a circular hole in the ground.

3. The combination according to claim 2 further including at least one second cylindrical sleeve and wherein said first sleeve is a cylindrical sleeve slidably retained in said second cylindrical sleeve for telescoping movement from a storage position within said second cylindrical sleeve to a use position extending downwardly from said second cylindrical sleeve.

4. The combination according to claim 3 wherein said second sleeve is slidably retained in the circular opening in said flange member by means of an outwardly extending lip on one end thereof, said lip having an external diameter greater than the diameter of the circular opening in said flange member.

5. The combination according to claim 4 wherein said housing has an aperture therethrough for admission of an operating tool, and said engagement fingers are carried by an operator attached adjacent the lower end of said first cylindrical sleeve for engagement by said operating tool inserted through the aperture in said housing.

6. The combination according to claim 5 wherein said housing is a domed housing.

7. The combination according to claim 1 further including at least one second cylindrical sleeve and wherein said first sleeve is a cylindrical sleeve slidably retained in said second cylindrical sleeve for telescoping movement from a storage position within said second cylindrical sleeve to a use position extending downwardly from said second cylindrical sleeve.

8. The combination according to claim 7 wherein said second sleeve is slidably retained in the circular opening in said flange member by means of an outwardly extending lip on one end thereof, said lip having an external diameter greater than the diameter of the circular opening in said flange member.

9. The combination according to claim 1 wherein said housing has an aperture therethrough for admission of an operating tool, and said engagement fingers are carried by an operator attached adjacent the lower end of said first cylindrical sleeve for engagement by said operating tool inserted through the aperture in said housing.

10. The combination according to claim 1 wherein said housing is a domed housing.

11. A safety hole cover including in combination:

a circular flange member having upper and lower sides for placement over a circular hole in the ground, said flange member having a circular opening therethrough;

a housing secured to said circular flange member and extending over and covering the circular opening in said circular flange member;

a plurality of cylindrical sleeves, each having upper and lower ends, telescopically retained in one another, the outermost of which has the largest diameter and the innermost of which has the smallest diameter, and said cylindrical sleeves being retained in the opening in said flange member for movement from a storage position in said housing to a use position extending downwardly below said circular flange member through the circular opening in said circular flange member into the hole to be covered, with the internal diameter of said hole determining the number of said cylindrical sleeves which extend downwardly through the opening in said flange; and movable engagement fingers adjacent the lower end of the innermost of said telescoping sleeves for movement from a retracted position within said innermost sleeve to an extended position to engage side walls of the hole when said cover is in place over the hole.

12. The combination according to claim 11 wherein each of said cylindrical sleeves has an outwardly turned lip at the upper end thereof and an inwardly turned lip at the lower end thereof, such that the outwardly turned lip at the upper end of each of the sleeves engages the inwardly turned lip of the immediately adjacent sleeve to permit a predetermined number of said sleeves to drop into a hole in the ground when said hole cover is placed over the hole, depending upon the internal diameter of the hole.

13. The combination according to claim 12 wherein said housing is a domed housing.

14. The combination according to claim 13 wherein said housing has an aperture therethrough for admission of an operating tool, and said engagement fingers are carried by an operator attached adjacent the lower end of said lowermost cylindrical sleeve for engagement by said operating tool inserted through the aperture in said housing.

15. The combination according to claim 11 wherein said housing is a domed housing.

16. The combination according to claim 11 wherein said housing has an aperture therethrough for admission of an operating tool, and said engagement fingers are carried by an operator attached adjacent the lower end of said lowermost cylindrical sleeve for engagement by said operating tool inserted through the aperture in said housing.

* * * * *